US008534580B2

(12) United States Patent
Rice et al.

(10) Patent No.: US 8,534,580 B2
(45) Date of Patent: Sep. 17, 2013

(54) GRANULATOR BLADE

(76) Inventors: Tim Rice, Mundeline, IL (US); Alejandro Casillas, Long Grove, IL (US)

( * ) Notice: Subject to any disclaimer, the term of this patent is extended or adjusted under 35 U.S.C. 154(b) by 0 days.

(21) Appl. No.: 12/852,992

(22) Filed: Aug. 9, 2010

(65) Prior Publication Data

US 2012/0032013 A1 Feb. 9, 2012

(51) Int. Cl.
*B02C 18/18* (2006.01)

(52) U.S. Cl.
USPC ..... 241/242; 241/294

(58) Field of Classification Search
USPC ..... 241/242, 243, 294
See application file for complete search history.

(56) References Cited

U.S. PATENT DOCUMENTS

| | | | | |
|---|---|---|---|---|
| 4,360,168 | A | 11/1982 | Peterson, Jr. | |
| 5,060,875 | A | 10/1991 | McBride | |
| 6,189,584 | B1 | 2/2001 | Cayce | |
| 6,269,714 | B1 | 8/2001 | Sakai | |
| 6,837,453 | B2 * | 1/2005 | Sturm | 241/243 |
| 7,011,261 | B2 | 3/2006 | Lee | |
| 7,584,921 | B1 * | 9/2009 | Bennington et al. | 241/294 |
| 7,634,897 | B2 | 12/2009 | Maclennanm et al. | |

* cited by examiner

*Primary Examiner* — Mark Rosenbaum
(74) *Attorney, Agent, or Firm* — Applied Patent Services; James D. Palmatier

(57) ABSTRACT

A rotary knife for a granulator having a two-piece design comprising a blade holder and a removable blade, the blade holder having a V-shaped saddle for holding the removable blade aligned. The V-shaped saddle having a flat surface for absorbing the shock of force transmitted by the blade shearing plastic and other materials for recycling and reuse.

17 Claims, 3 Drawing Sheets

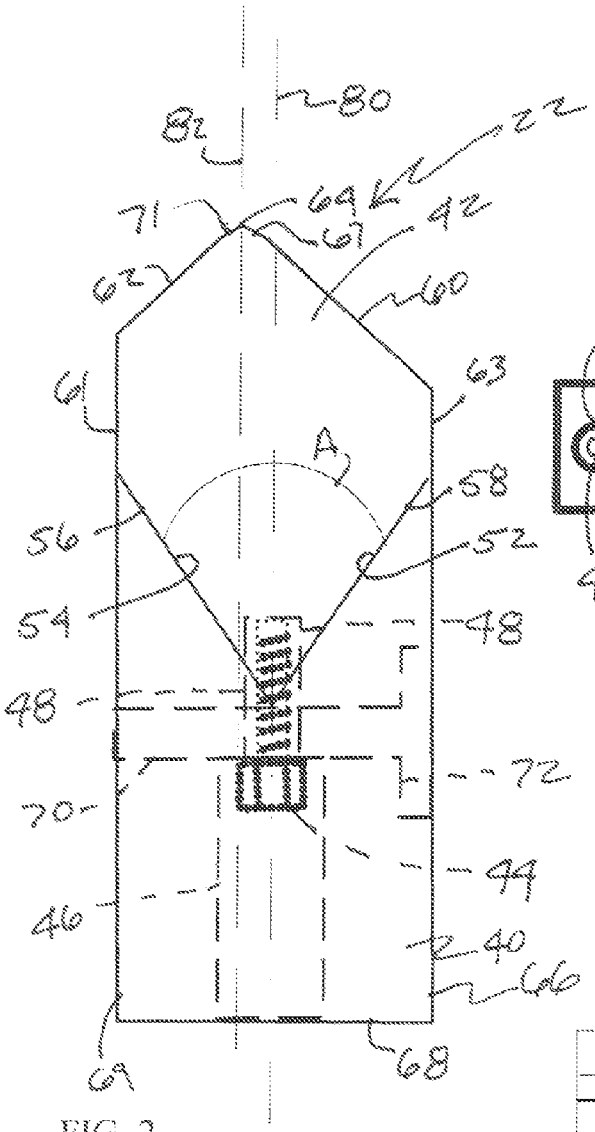
FIG. 2
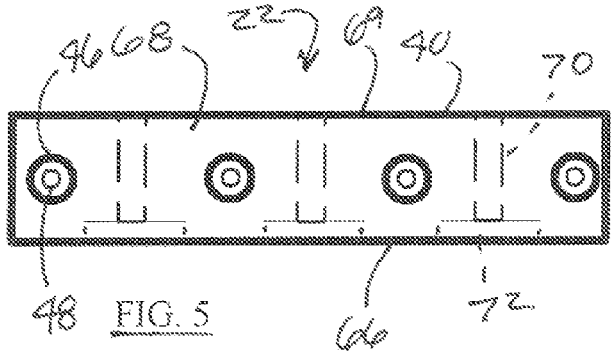
FIG. 5
FIG. 3
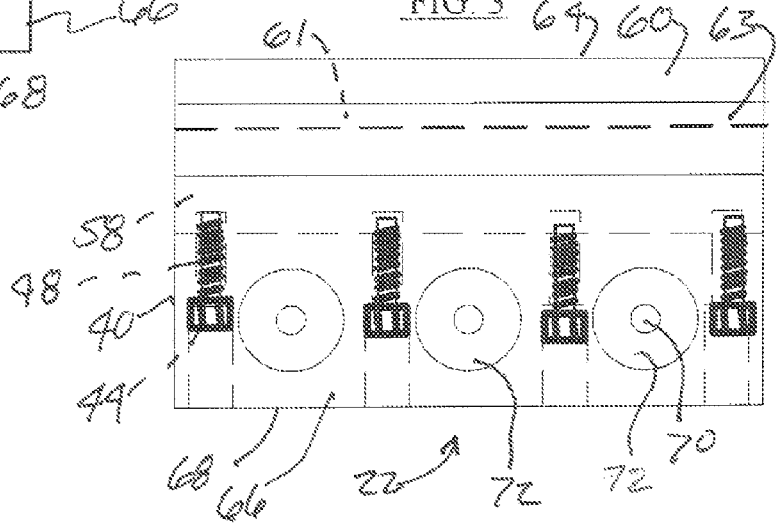

GRANULATOR BLADE

FIELD OF THE INVENTION

The present invention relates generally to blades used in granulators, grinders or mulchers for reducing waste such as plastic pieces to pellets or chips. Such machines when used with plastic are typically part of a manufacturing line to grind scrap parts for melting and reformation into new parts. The machine typically comprises an input hopper gravity feeding into a shear comprising a rotary component having a plurality of blades mounted thereon positioned to chop with a fixed bed blade. More particularly, the present invention comprises a modular rotary blade having a removable edge adapted to reduce maintenance and downtime,

BACKGROUND OF THE INVENTION

Granulators are part of a class of machines used to reduce scrap to chips or small pieces. These machines are used to regrind plastic parts for remelting and forming into new parts. Similar machines are used to grind trees and wood cuttings into mulch, grind automotive tires for recycling and chop electronic parts for separation of materials and precious metals. Screens are used in the cutting chambers to sort out pieces that are of a desired size. The pieces are cut or chopped until they are of a size to escape the cutting chamber and fall into the output bin or discharge.

The machines are configured to grind or chop a particular material with the blades selected to perform the necessary cutting action. The blades are formed from hardened steel or alloy and the cutting edge ground depending on the material to be processed. Continuous hard use and shocks to the blade may damage them requiring the place to be removed and be sharpened. The shock absorbed by the blade may be caused by foreign objects dropped into the hopper. Foreign objects such as nuts or bolts, personal jewelry, etc., may fall into the granulator from time to time and cause damage to the blades. The blades may also need to be resharpened after use.

Typically the blades on the rotary cutter are kept together in a set. The blades are ground to a preselected dimension. Likewise the bed blades are treated as a set and similarly ground together to a preselected dimension. The blades when assembled on the machine require a calibration of the rotary cutter and the bed blades to adapt the positioning for cutting in a desired dimension. Replacing the blades and adjusting the machine requires downtime of the machine. Further, the blades are expensive due to the high quality material used.

Multipart blades have been designed to use a hardened steel cutter blade attached to a soft steel carrier. These blades require a large carrier and fasteners are to absorb the shock of the cutting action. The weight of these blades make shipping the blade for resharpening expensive. In addition, the construction of these blades demands the blades be expensive. Accordingly, it is desirable to have a cutting blade that may be retrofitted on a standard rotor having an inexpensive, blade holder formed of plastic, composite or inexpensive metal and a cutter blade of tool steel removably Attached thereon. The cutter blade securely fastened to the blade holder and adapted to directly transferred the shock of the cutting action to the late holder. The cutter blade being removable from the blade holder to allow shipping only the cutter blade for resharpening.

BRIEF SUMMARY OF THE INVENTION

One embodiment of the present invention is directed to a multipart blade for attachment to a rotor of the granulator. The multipart blade having a blade holder made of an inexpensive material such as plastic, a composite or steel and a cutting blade formed from a hardened alloy or tool steel. The blade holder having a shape and mounting configuration of a standard rotor blade and a V-shaped saddle for receiving the rotor cutting blade.

The blade holder having a body extending the length of the rotor cutting blade. The body having a plurality of mounting holes for attaching to the rotor. The blade holder further comprising a V-shaped saddle formed along the front edge. The V-shaped saddle extending the length of the blade holder. The V-shaped saddle having a first side, second side and a first edge. The first side and the second sidedisposed at a predetermined angle to each other. One of the sides adapted to be generally perpendicular to the shock force applied to the blade when mounted to the rotor and chopping material. A blade hole is formed extending from the back edge to the V-shaped saddle in the front edge. The blade hole extending through the first edge.

The cutting blade having a cutting edge, two sides and a mounting edge. The cutting blade may be formed of a hardened steel or alloy such as D2. The mounting edge having a V-shaped mounting edge adapted to fit into the V-shaped saddle. A carrier hole is formed in the mounting edge having a carrier hole axis generally parallel to one of the two sides. The carrier hole disposed along the mounting edge to align with the blade hole in the blade holder. A threaded fastener extended into the blade hole from the back edge of the blade holder extending through the V-shaped saddle and into the carrier hole is used to hold the cutting blade in the V-shaped saddle.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE SEVERAL VIEWS OF THE DRAWINGS

FIG. 2 is an end plan view of the first embodiment.

FIG. 3 is a side elevation view of the first embodiment.

FIG. 5 is a bottom plan view of the first embodiment.

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
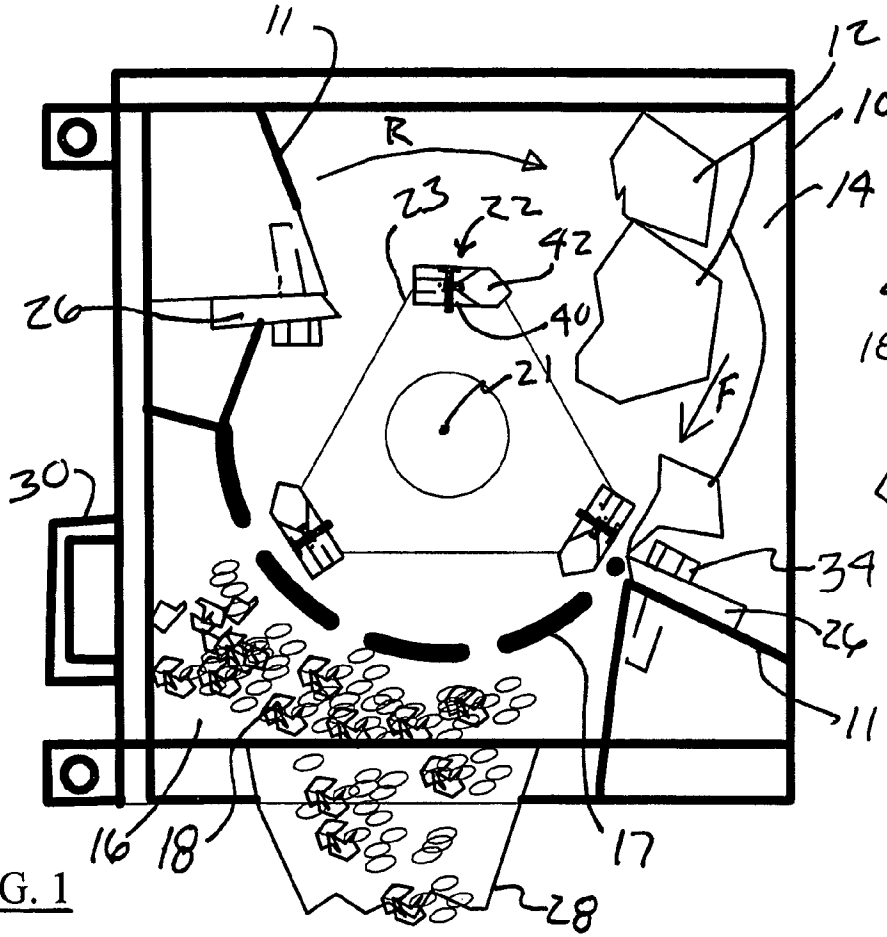
FIG. 1 is a section view of the granulator assembly illustrating the first embodiment mounted on the rotor.

Referring to FIG. 1, the present invention comprises a blade for use and a granulator, generally indicated by reference number 10. The granulator 10 comprises a generally rectangular box shape body 12 having a rotor 20 used to chop pieces of plastic waste 12. The granulator may comprise a frame 11, an input chamber 14, and a discharge chamber 16. The input chamber 14 and discharge chamber 16 separated by a screen 17. Chopped pieces of plastic 18 are formed by the rotor 20 carrying rotor blades 22 rotating about rotor axis 21. The rotor 20 rotates in a direction indicated by arrow R causing the rotor blades 22 to interface with bed blades 26 in cutting force direction F to reduce plastic 12 to pieces 18.

Continuing to refer to FIG. 1, granulator 10 further comprises a discharge chute 28 and a door 30 having a handle for accessing the discharge area 16. Threaded fastener 32 may be used to attach rotor blade 22 to rotor 20 along outer peripheral edge 23. Likewise, threaded fastener 34 may be used to attach bed blades 26 to granulator frame 11.

Referring to FIG. 2, the rotor blade 22 further comprises blade holder 40 and cutting blade 42. Blade fastener 44 extends through blade hole 46 threadably engaging cutting blade 42 at carrier hole 48. The V-shaped saddle 50 formed along the front edge 51 of blade holder 40, the V-shaped saddle 50 further comprising a first saddle side 52, second saddle side 54 and inner edge 55. First saddle side 52 and second saddle side 54 disposed at a saddle angle of approximately 45° angle. Blade holder 40 may be formed from metal, composite or plastic. Rotor blade 22 a formed of tool steel such as D-2.

Continuing to refer to FIG. 2, cutter blade 42 comprises first mounting side 56 and second mounting side 58 adapted at a saddle angle to each other to fit into the V-shaped saddle 50. The saddle angle A may be approximately 45° for adapting to a similarly formed V-shaped saddle. Cutter blade 42 further comprises a cutting edge 64 defined by first cutting side 60 and second cutting side 62 which may be ground to a particular edge configuration 59. Blade side 61 between first mounting side 56 and second cutting side 62 and blade side 63 between second mounting side 58 and first cutting side 60 provide additional tool steel material to allow cutter blade 42 to be resharpened. In a low profile cutter blade 42, first cutting side 60 may be on second mounting side 58 and second cutting side 62 may be on first mounting side 56. Cutter blade 42 disposed in V-shaped saddle 50 may have first saddle side 52 bearing against second mounting side 58 and second saddle side 54 bearing against first mounting side 56. Carrier hole 48 and laid hole 46 are lined to allow insertion and engagement by the blade fastener 44. Blade 42 may be sharpened to have first blade step 67 second blade step 71 adjacent edge 64.

Referring to FIG. 3, granulator blade 22 may have cutting blade 42 mounted on blade holder 40 at V-shaped saddle 50. Blade holder 40 may have an outside 66 and a back edge 68. Back edge 68 is spaced from V-shaped saddle 50. A mounting hole 70 preformed through blade holder 40 having a recess 72 formed in the outside 66. the mounting hold 70 is disposed in a standard blade configuration for retrofit without modification to the rotor 20.

Figures 4, 6:
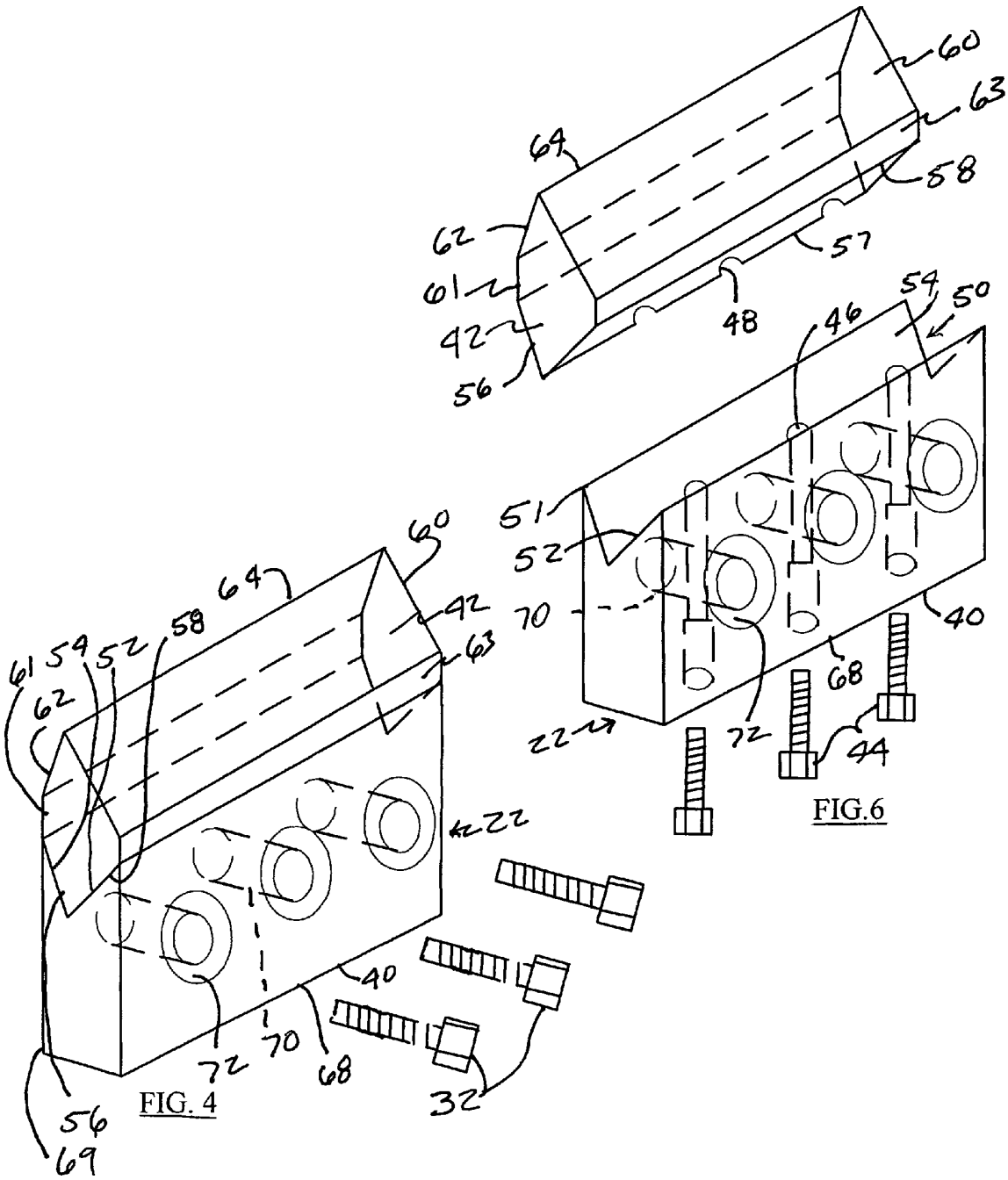
FIG. 4 is a perspective view of the first embodiment.
FIG. 6 is an exploded perspective view of the first embodiment.

Referring to FIG. 4, the granulator blade 22 may have the cutting blade 42 formed at approximately the same length as the blade holder 40. A pair of cutting blade sides 61, 63 may be adapted to align with holder inside 69 and outside 66 respectively. Blade holes 46 are spaced intermediate mounting holes a 70 and adapted to allow removal of the blade 42 without removal of the holder 40 from the rotor 20.

Referring to FIG. 5, blade holes 46 are formed in back edge 68 extending through to the V-shaped saddle 50. Mounting holes 70 extend from the outside 66 of the blade holder 40 through the blade holder 40 to inside 69.

Referring to FIG. 6, the cutting blade 42 has a mounting surface 57 which may be adapted to fit into the V-shaped saddle 50. Carrier holes 48 are disposed to align with the blade holes 46 for insertion of blade fastener 44. First of mounting side 56 and second mounting side 58 may be disposed at a substantially similar angle to the saddle angle between first saddle side 52 and second saddle side 54.

Figure 7:
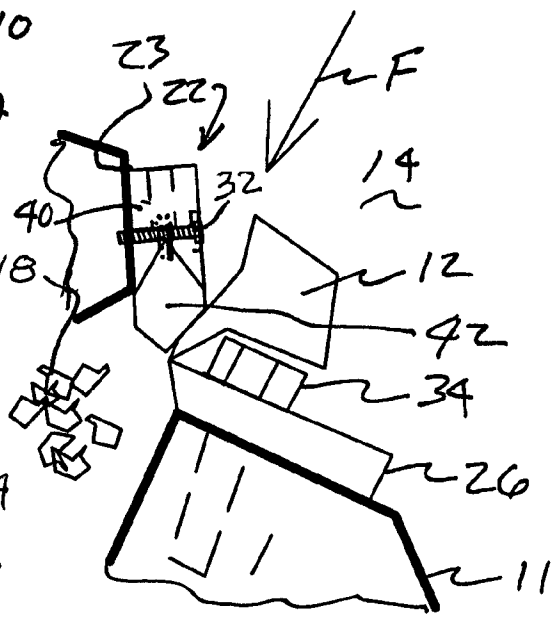
FIG. 7 is an elevation view of rotor blade having a blade holder with a V-shaped saddle.

Referring to FIG. 7, inner edge 55 of V-shaped saddle 50 is formed approximately at cutter blade axis 80. First cutting side 60 and second cutting side 62 are formed at the blade axis 82. Cutter blade axis 80 is in spaced relation to blade axis 82. Cutting edge 64 is formed in spaced relation to edge axis 82 to direct the cutting force F, at a force angle of attack, approximately perpendicular to first saddle side 52 and second mounting side 58. Cutting force F is directed on to rotor blade 22 has cutting edge 64 to engage plastic piece 12 with bed blade 26. Bed blade 26 likewise may comprise a blade carrier 86 with a removable blade 88 adapted to be positioned to cause a shearing force on plastic piece 12 as rotary blade 22 rotates about rotor axis 21 and moves into engagement position with bed blade 26.

Continuing to refer to FIG. 7, rotor blade 22 is attached to rotor 20 and adapted to engage bed blade 26. Plastic waste 12 is chopped by the cutting action between rotor blade 22 and bed blade 26. Bed blade 26 is securely fastened to granulator frame 11. Rotor blade 22 is securely fastened to rotor 20. Rotor blade 22 comprises a blade holder 40 having a V-shaped saddle 50 disposed to orient one of the first saddle side 52 or second saddle side 54 approximately perpendicular to cutting force direction F.

In use, the cutting blade holder 40 is mounted to the rotor 20 rotation about center axis 21. The bed blade 26 may be adjusted and attend gentle direction to the rotation of rotor 20 and are to position the rotor blade 26 because a cutting action in conjunction with rotor blade 22. Rotor blade 22 may have cutting blade 42 attached to blade holder 40. As pieces of material 12 are granulated by interface of the rotor blade 22 with the bed that blade 26, small pieces 18 well exit to screen 17 and out through discharge chute 28. Cutting blade 42 may become doll true continued use or by hitting a foreign object 90 (FIG. 7). Cutting blade 42 may be removed from rotor 20 without removal of the blade holder 40 to reduce downtime.

It should be understood, the plurality of rotor blades 22 may be attached to rotor 20. Each rotor blade is essentially identical in size and configuration. The discussion here and discusses a single rotor blade however is understood the discussion applies to each of the individual rotor blades use on a rotor 20. The removable blade 22 is mounted on the rotor 20 having one of the first saddle side or second saddle side 52, 54 approximately radially aligned with a diameter of the rotor 20. This alignment of the first saddle side or second saddle side 52, 54, together with the offset position of the cutting edge 64 such that axis 82 (FIG. 2) is approximately tangential to the diameter of the rotor 20 to direct the force F applied to the rotor knife when cutting plastic pieces 12, or other material, against the radially aligned side 52, 54.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

We claim:

1. A granulator assembly, the granulator assembly having a frame, a rotor, input hopper, and an output bin, the rotor having a diameter and an axis of rotation, the granulator assembly further comprising:

a bed blade on the frame, the bed blade between the input hopper and the output bin;

a rotor blade mounted on the rotor, the rotor blade adapted to interface with the bed blade at a force angle of attack, the rotor blade further comprising a blade holder attached to a removable cutting blade, the removable cutting blade comprising a cutting edge, and a mounting surface, the mounting surface further comprising a first mounting side and a second mounting side the blade holder having an inside surface on the rotor and an outside surface; and a V-shaped saddle on the blade holder, the V-shaped saddle comprising a first saddle side and a second saddle side, the second saddle side adapted to engage and bear against the first mounting side, the second saddle side further adapted to be approximately perpendicular to the force angle of attack.

2. The invention of claim 1, further comprising a blade fastener in the blade holder, material removed from the blade to form a carrier hole, the carrier hole adapted to fixedly engage the blade fastener.

3. The invention of claim 1, wherein blade holder further comprises an outside surface, an inside surface and a back edge, the back edge is spaced from the V-shaped saddle, the outside surface spaced from the inside surface, a plurality of mounting holes extending from the outside surface to the inside surface.

4. The invention of claim 3, further comprising a blade hole formed by material removed from the blade holder, the blade hole extending from the back edge to the V-shaped saddle.

5. The invention of claim 4, further-comprising a blade fastener in the blade holder, material removed from the blade to form a carrier hole, the carrier hole adapted to fixedly engage the blade fastener.

6. The invention of claim 1, wherein the V-shaped saddle further comprises an inner edge, an inner edge disposed between the inside surface and the outside surface.

7. The invention of claim 6, further comprising a blade axis in the rotor blade, the inner edge disposed on the blade axis, the cutting edge formed on an edge axis, the edge axis spaced from the blade axis.

8. The invention of claim 7, wherein the edge axis is intermediate the blade axis and the inside.

9. The invention of claim 1, wherein the force angle of attack is approximately perpendicular to one of the first saddle side or the second saddle side.

10. A granulator assembly, the granulator assembly having a frame, a rotor, an input hopper, and an output bin, the rotor having a diameter and an axis of rotation, the granulator assembly further comprising:

a two piece bed blade, the bed blade having a bed blade holder attached to the frame and a removable bed cutting blade;

a blade holder on the rotor, the blade holder comprising an inside surface, an outside surface, a front edge and a back edge, the front edge further comprising a V-shaped saddle having a first saddle side and a second saddle side disposed at a saddle angle to each other, the first saddle side and the second saddle side joined at an inner edge the inner edge generally parallel to the axis of rotation of the rotor, the first saddle side extending from the inner edge at an orientation generally aligned with the diameter of the rotor;

a removable cutting blade on the blade holder, the removable blade comprising a cutting edge, a mounting surface, a pair of blade sides, material removed to form a carrier hole, the carrier hole in the mounting surface, the cutting edge disposed to interface with the two piece bed blade.

11. The invention of claim 10, wherein the cutting edge is disposed at an edge axis, the edge axis extending from the mounting surface to the cutting edge, the edge axis disposed in a position not equidistant from each of the pair of blade sides, the cutting edge disposed to direct a cutting force between bed blade and the removable cutting blade approximately perpendicular to first saddle side.

12. The invention of claim 11, further comprising a blade hole formed in the blade holder, the blade hole extending from the back edge to the inner edge.

13. The invention of claim 11 wherein the cutting blade further comprises a blade axis in the rotary cutting blade, the blade axis extending from the back edge of the blade holder through the inner edge, the blade axis approximately equidistance between the inside surface and the outside surface, the blade axis spaced from the edge axis whereby the removable blade interfaces with the fixed bed blade with a cutting force oriented approximately tangential to the diameter of the rotor.

14. The invention of claim 13, wherein the cutting force is directed at a force angle of attack approximately perpendicular to the first saddle side.

15. The invention of claim 13 wherein the blade holder further comprises a plurality of blade holes formed by material removed from the back edge to the V-shaped saddle and a plurality of mounting holes formed by material removed from the inside surface to the outside surface and further comprising a blade fastener in each blade hole threadably engaging the removable cutting blade and a threaded fastener in each mounting hole for attaching the blade holder to the rotor.

16. The invention of claim 15, wherein the mounting hole further comprises a recess on the outside.

17. A granulator assembly, the granulator assembly having a frame, a rotor, an input hopper, and an output bin, the rotor between the input hopper and the output bin, a plastic piece in the input hopper, the rotor further having a diameter and an axis of rotation, the rotor axially attached to the granulator, the rotor rotating about the rotor axis, the granulator assembly further comprising:

a two piece rotor blade comprising a blade holder and a removable cutting blade, the blade holder attached to the rotor, the blade holder having a back edge, a front edge, an inside surface and an outside surface, a V-shaped saddle on the front edge, the V-shaped saddle comprising material removed from the front edge to form an indention in the front edge comprising a first saddle side and a second saddle side, the first saddle side joined to the second saddle side at an inner edge, the first saddle side disposed at a saddle angle with respect to the second saddle side, the first saddle side further radially aligned with the diameter of the rotor, material removed from the outside surface to form a mounting hole extending through to the inside surface, and material removed from the back edge to form a blade hole extending to the V-shaped saddle, the removable blade on the blade holder, the removable blade having a cutting blade axis, a mounting surface and a cutting edge, the mounting surface adapted to fit in the V-shaped saddle, the cutting edge offset from the cutting blade axis and spaced from the blade holder whereby the cutting edge engages the plastic piece with a cutting force directed approximately perpendicular to first saddle side; and a bed blade, the bed blade comprising a blade holder on the frame and a removable blade attached to the blade holder, whereby the removable blade may be replaced without taking the blade holder off the frame.

* * * * *